United States Patent [19]

Dickinson

[11] 4,318,079

[45] Mar. 2, 1982

[54] MOTORIZED TIRE BARRIER AND SIGNAL BARRIER TRAFFIC-WAY CONTROLLER

[76] Inventor: Harry D. Dickinson, 1681 Larco Way, Glendale, Calif. 91202

[21] Appl. No.: 160,945

[22] Filed: Jun. 19, 1980

[51] Int. Cl.[3] ..... G08G 1/02; E01F 11/00

[52] U.S. Cl. ..... 340/127; 340/45; 340/51; 340/114 B; 340/130; 340/138; 246/292; 116/52

[58] Field of Search ..... 340/45, 51, 127, 129, 340/130, 138, 142, 114 R, 114 B, 115–117; 246/292, 293, 294, 297, 302, 272, 125, 127; 116/39, 40, 51, 52; 49/49, 324; 318/4, 5, 10, 468, 390, 591, 34, 35, 98, 101, 626; 256/10, 13.1

[56] References Cited

U.S. PATENT DOCUMENTS 2,795,875 6/1957 Nutter et al. ..... 340/51
2,842,876 7/1958 Chicoine et al. ..... 340/51

FOREIGN PATENT DOCUMENTS 652772 3/1929 France ..... 340/114 B

*Primary Examiner*—John W. Caldwell, Sr.
*Assistant Examiner*—Donnie L. Crosland
*Attorney, Agent, or Firm*—William H. Maxwell

[57] ABSTRACT

A motorized traffic-way controller wherein a retractile tire barrier and opening gate barrier are coordinated to operate in unison by a motor drive that is recycled by closing a mode switch through cam controlled "stop" and "go" switches responsive to the position of the motor drive, the installation being above grade with low profile modules having retractile tooth configurations that projects for tire damage, and with a signal barrier supported by a drive unit at the side of the traffic-way and in the form of an arm that is lifted when the tooth configuration is retracted, the modules and drive unit being adapted to coupled engagement one with the other when assembled.

19 Claims, 12 Drawing Figures

X
X'
X''
Y
Z
10
11
12
13
14
15
16
17
18
18'
18''
20
35
36
38
39
51
56
2
3
4
5
6

X
X'
X''
Z
B
C
R
M
14
14'
14''
17
18
18'
18''
19
19'
20
21
22
23
28
29
30
32
33
34
51
52
53
54
55
L1
L2
L3

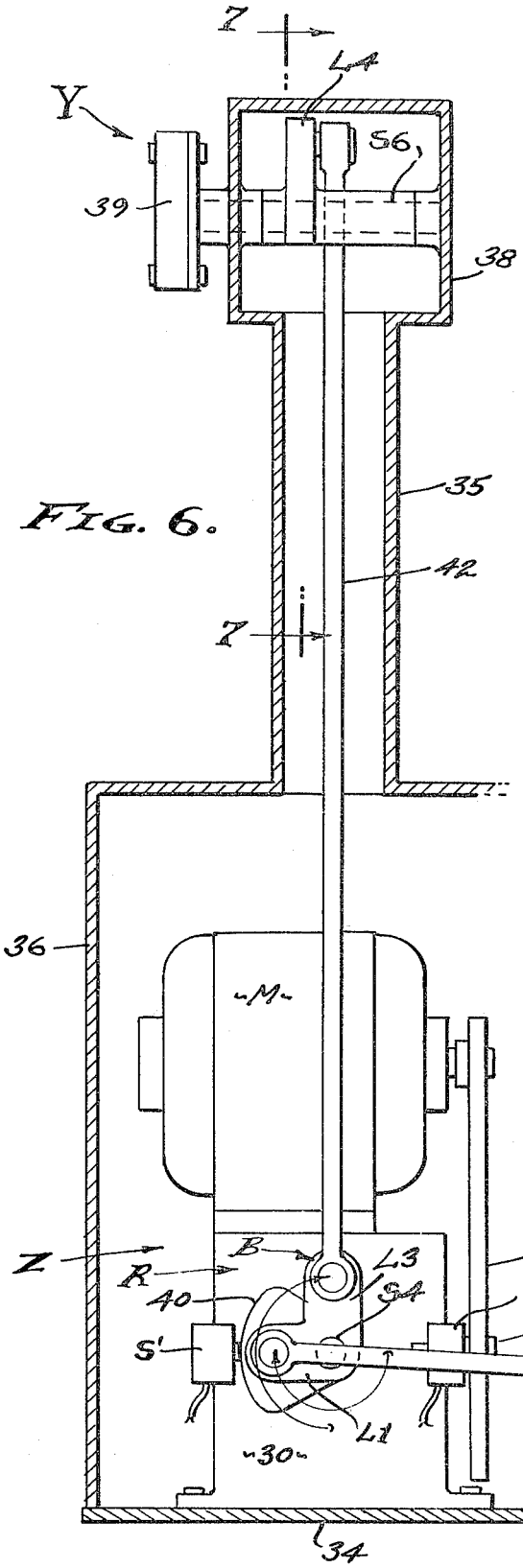
FIG. 6.
FIG. 7.
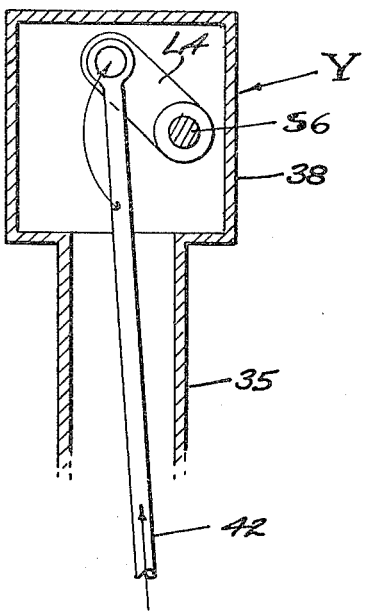
FIG. 8.
"STOP" MODE
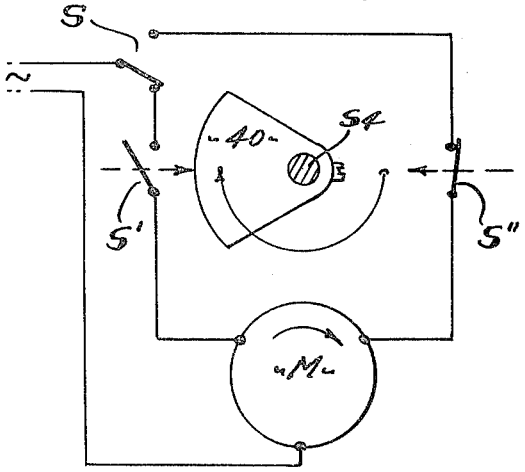

39
10
Y
56
38
L4
35
42
10
36
"M"
33
I
L1
40
S"
54
S'
S5
32
L3
B
"30"
34
S3
L2

L4
56
38
35
42

"GO" MODE
S
54
"40"
S'
S"
"M"

MOTORIZED TIRE BARRIER AND SIGNAL BARRIER TRAFFIC-WAY CONTROLLER

BACKGROUND

Traffic controllers are utilized as intimidating devices that preclude traffic of automobiles at the entrances and exits of parking areas and the like. That is, a visible barrier is presented at the pavement level so as to permit the desired traffic flow by means of its retraction, and so as to cause or likely to cause tire damage to unauthorized traffic by means of its visible configuration of projecting tooth members. Gates are operated in conjunction with the operation of these traffic controllers, some of which are spring biased so as to prevent reverse flow of traffic, and others motorized for tooth retraction and projection. The tooth configuration is menacing when projected above the pavement level, and can be the cause of unwarranted damage in the event that a vehicle is inadvertently reversed. The gate is therefore coordinated with an admission means, such as for example a coin operated admission control means, the gate being raised from a horizontal blocking position so as to permit admission. It is a general object of this invention to coordinate the operation of such a traffic controller and an admission gate whereby the admission function of one is interdependent upon the other.

The traffic controller is in a sense obscure as it is low lying and the teeth but a few inches tall when projecting. Accordingly, the use of an admission gate overlying the traffic controller is to be desired in order to signal the vehicle driver whether or not to proceed. Although a traffic controller of tooth configuration is most effective, attempted defeat thereof invariably results in tire damage as a deterrent. The control and positioning of retractile curbs is not to be excluded as such a curb configuration is also to be coordinated with the admission gate disclosed herein. A feature herein is the simultaneous operation of the traffic controller and admission gate, by a common drive means therefor responsive to a suitable admission control means, it being an object of this invention to provide drive means for the sequential recycling of the traffic controller and admission gate through alternate traffic blocking and traffic flow positions. With the present invention the flow of traffic can be in either direction, retraction and projection of the tooth barrier, and lifting and lowering of the gate barrier being positive in each instance. In practice, an electric motor drive is employed, a non-reversible drive under control of a cam actuated stop switch and an overriding manually actuated start switch. It is to be understood that an equivalent hydraulic drive means can be employed.

Most often, it is desirable and/or required that the installation of traffic controllers and admission gate mechanisms be above grade. That is, there are situations where a driveway is already constructed, or incorporated in a prestressed slab, which precludes modification of the supporting plane. In other words, sumps and like depressions are not permissible, in which case an above grade installation is a requirement. Accordingly, it is a low profile above grade traffic controller which is an object herein, composed either of a tooth configuration or a curb configuration, and adapted to be power operated through a motor drive means also above grade.

The motorization employed herein involves the rotation of shafts on right angularly related axes, the tooth and/or curb configuration on a transverse axis juxtaposed to the grade level, and the admission gate on a longitudinal axis spaced substantially above grade at one side of the traffic-way. The transverse axis of the traffic controller shaft lends itself to alternate retraction and projection of the tooth and/or curb configuration, while the longitudinal axis of the admission gate shaft lends itself to alternate raising and lowering of the admission gate. When the admission gate is lowered the traffic controller tooth and/or curb configuration is projected; and conversely when the gate arm is raised the traffic controller is retracted. These functional requirements are inherently met by the motor drive means as later described.

A feature and object of this invention is the modularity of its interrelated components, all above grade. As shown, the traffic controller is embodied in modular sections with the control shafts thereof coupled for unison operation. As shown, there is a toothed module for right and left sides of the driveway, leaving the center clear. However, the center module can be complete with said barrier configuration and also comprises a control shaft coupled for said unison operation of the right and left modules. As shown, a drive unit module occupies one side of the traffic-way and carries the standard through which the longitudinal control shaft of the admission gate is operated. It will be observed that the combination traffic controller and admission gate has a definite and coordinated rule of action dependent upon a common motor drive means with a stop and start switch control.

SUMMARY OF THE INVENTION

This invention relates to the control of traffic through the coordinated effect of a grade level tire barrier and an above grade signal barrier that is visible to the vehicle driver. The grade level barrier tends to be obscure, thus requiring the above grade barrier which ensures proper control over the flow of vehicular traffic. The admission or coin control is not part of this invention, but it is to be understood that such a control is remote and varies as circumstances require. For example, a coin operated admission means closes a series circuit through the mode switch hereinafter described in order to bypass "stop" and "go" switches and thereby recycle the motor drive means. The tire barrier X herein disclosed is a series of modules coupled together transversely of the traffic-way, characteristically of low profile cross section and preferably above grade. That is, the supporting plane need not be disturbed. The signal barrier Y herein disclosed is an admission gate in the form of an arm disposed transversely of the traffic-way when lowered and pivoted on a longitudinal axis to be raised at one side of said traffic-way. The drive unit Z herein disclosed is an above grade module at the side of the traffic-way and comprised of a standard that attaches to the tire barrier X and carries the signal barrier Y, and also accommodates the drive means that coordinates the two admission means X and Y.

The foregoing and other various objects and features of this invention will be apparent and fully understood from the following detailed description of the typical preferred forms and applications thereof, throughout which description reference is made to the accompanying drawings.

DESCRIPTION OF THE DRAWINGS

FIG. 6 is an enlarged sectional view taken as indicated by line 6—6 on FIG. 1, showing the drive unit in the "stop" mode.

FIG. 7 is a sectional view taken as indicated by line 7—7 on FIG. 6.

FIG. 8 is an electrical diagram for control and shown in the "stop" mode; and, FIGS. 9, 10 and 11 are views similar to FIGS. 6, 7 and 8 respectively and showing the "go" mode.

PREFERRED EMBODIMENT

Figures 1, 2, 2A:
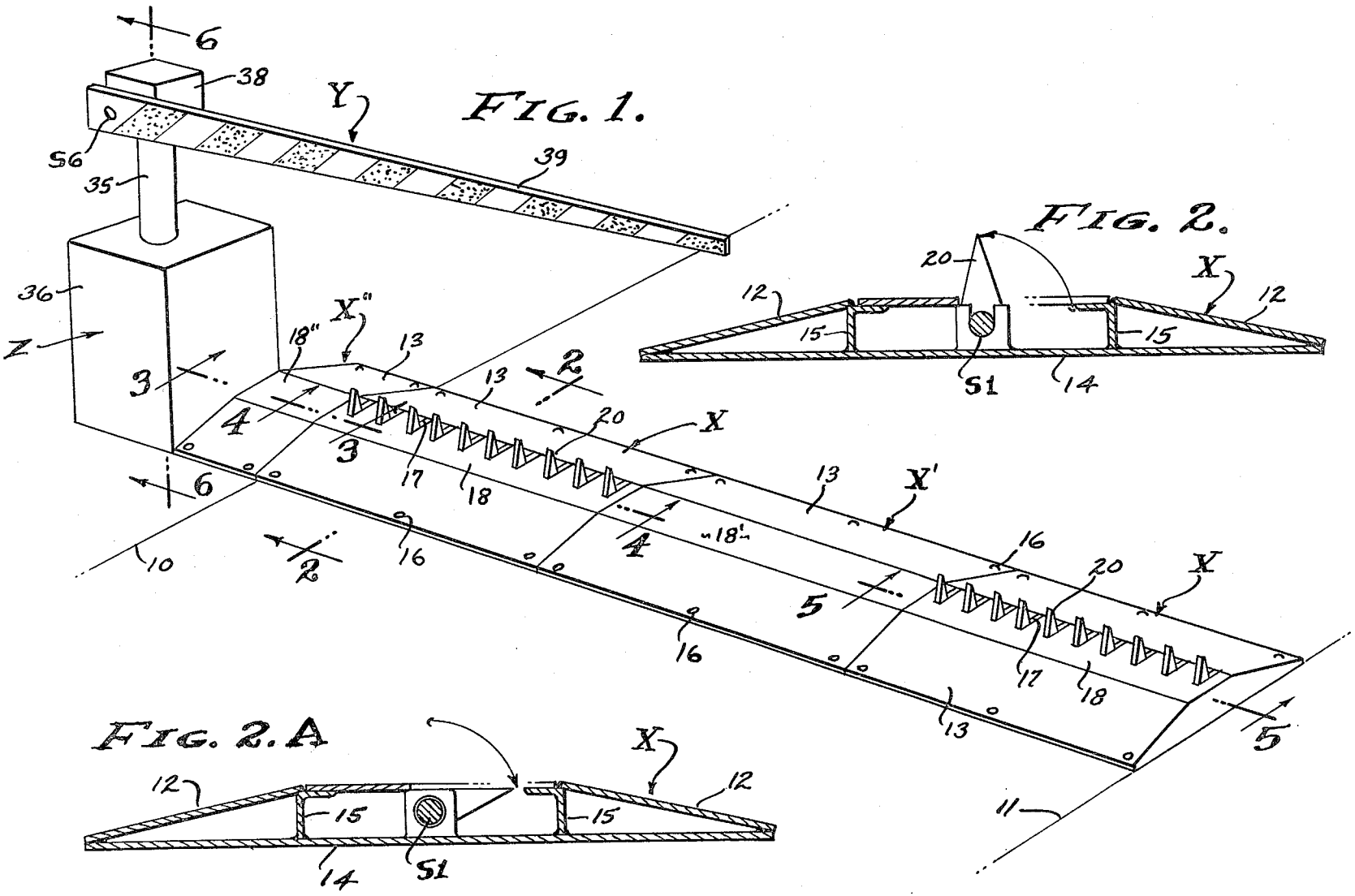
FIG. 1 is a perspective view of a traffic controller installation embodying the present invention.
FIG. 2 is an enlarged sectional view taken as indicated by line 2—2 on FIG. 1 and showing the "stop" position of the tire barrier.
FIG. 2A is a view similar to FIG. 2 and shows the "go" position of the tire barrier.

Referring now to FIG. 1 of the drawings, this traffic controller involves, generally, one or more tire barrier modules X, a signal barrier Y and a drive unit Z. The boundaries of a traffic-way are indicated at 10 and 11, the modules X and barrier Y extending transversely of the traffic-way to control traffic as may be required. Assuming that a normal four wheeled passenger vehicle is to be controlled, there is at least one and preferably two barrier modules, one placed in the path of each of the right and left wheels, normally centered approximately six feet apart. Accordingly, there is a center module which may or may not be a tire barrier module; in this case (FIG. 1) shown as a tunnel module X′ approximately three feet in length. To one side of the traffic-way there is also a drive module X″ extending from the drive unit Z which carries the signal barrier Y, the standard thereof being spaced laterally from the traffic-way. The aforesaid means and modules are all interconnected and coupled to be operated by the drive unit Z and suitably powered, for example electrically or hydraulically powered through a control circuit or the like involving a mode switch S and "stop" and "go" switches S′ and S″. It is to be understood that the transverse extent of the tire barrier assembly can be augmented or diminished from that shown, simply by coupling together the required modules X and X′, as circumstances require.

In accordance with this invention, the barrier modules X, tunnel module X′ and drive module X″ are of the same or identical cross section, comprised of a frame F of spaced and parallel rails 15 to which ramps 12 extend from the opposite margins 13 of a base 14. The rails 15 establish the height of the channel defined thereby to open upwardly. In practice, the ramps 12 and base member 14 are planar sheet or plate steel of rectangular configuration, and the rise for the opposite inclined planes is established by the top flange or spacer over the rail members 15 as shown. A feature is the horizontally coplanar top surface of the rails 15 that carry the ramps 12, and all of which is integrally welded along the edges of joinder. In practice, the rails are parallel and spaced ten inches to the outside thereof respectively. Fastener openings are spaced along the margins 13 for the reception of hold-down fasteners 16, and adhesive being used between the base 14 and pavement surface for securement, all as circumstances require. It will be seen that the frame F is essentially the same for all modules X, X′ and X″.

The barrier module X is characterized by its retractile tooth configuration which is operable through slotted openings 17 in a cover plate 18. The tooth shape is that of a plurality of blades 20 incrementally spaced apart approximately four inches along a shaft S1 that is rotatably supported upon spaced bearings 19 on the base 14, the axis of which is midway between the base 14 and plate 18. The blades 20 are pointed to project several inches above the plate 18 when raised by the shaft S1 as shown in FIG. 2, and they are adapted to retract through the slotted openings 17 when lowered by the shaft S1 as shown in FIG. 2A. The shaft S1 revolves through approximately 90° in order to raise and lower the blades, said blades being alike and integrally welded to said shaft in gang formation to move therewith.

Figures 3, 4, 5:
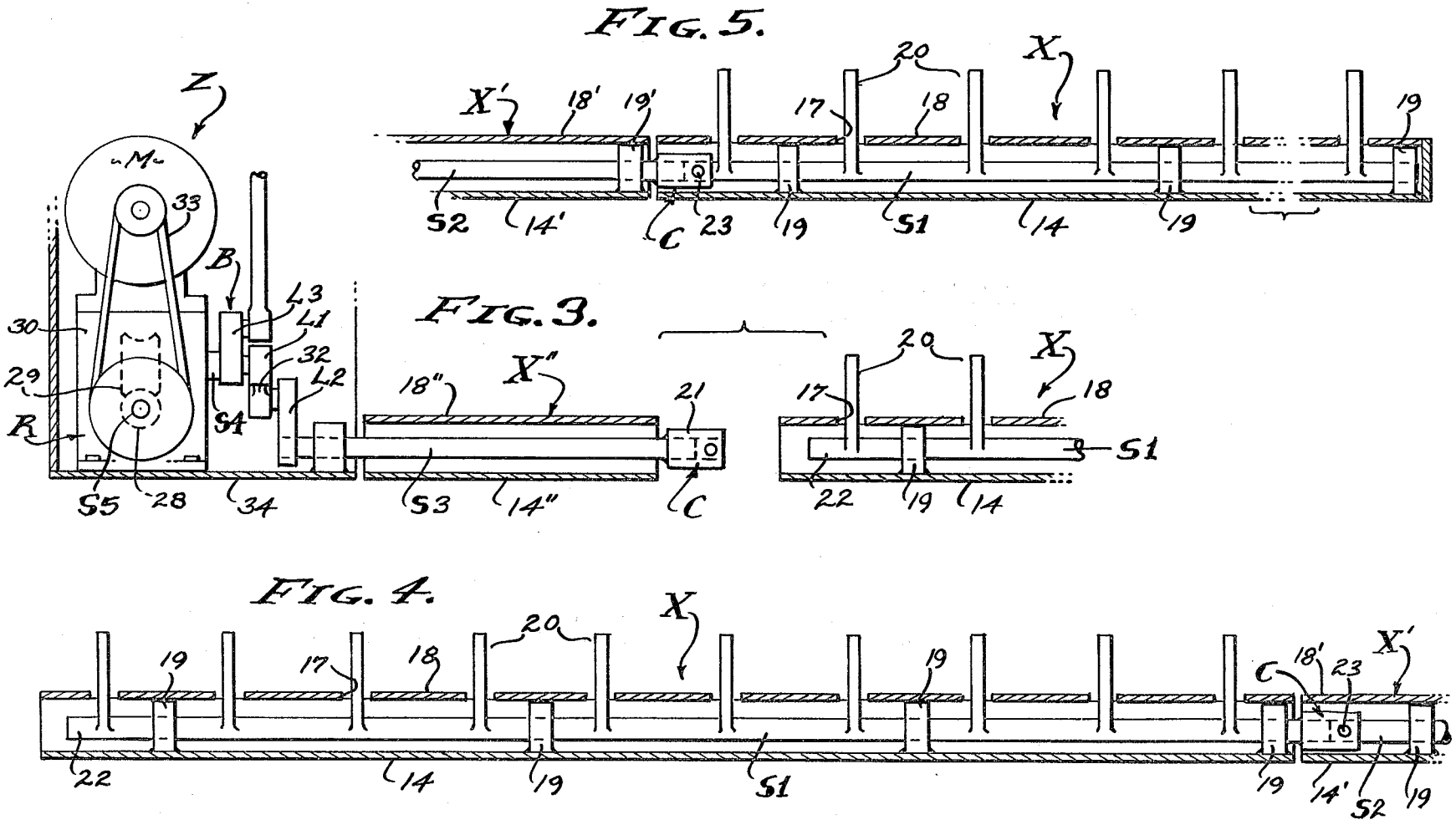
FIGS. 3, 4 and 5 are sectional views of the tire barrier taken as indicated by lines 3—3, 4—4 and 5—5 on FIG. 1.

The tunnel module X′, like the module X, rotatably carries a shaft S2 upon spaced bearings 19′ on the base 14′ thereof, the axis of which is midway between the base 14′ and plate 18′. In this module the plate 18′ is imperforate as there is no tooth configuration, the shaft S2 being rotatable to transmit the tooth position from one module X to another, as shown in FIGS. 4 and 5.

The drive module X″, like the modules X and X′ above described, rotatably carries a shaft S3 upon spaced bearings 19″ on the base 14″ thereof, the axis of which is midway between the base 14″ and plate 18″. In this module the plate 18″ is also imperforate as there is no tooth configuration, the shaft S3 being rotatable to transmit the angular displacement from the drive unit Z to the modules X and X′, as will be described.

In accordance with this invention, the modules X, X′ and X″ are compatable so as to be coupled one to the other. It is the ramp 12 and cover plate 18 configuration which continue one into the other in coplanar alignment, and it is the alignment of the shafts S1, S2 and S3 which is coaxial. Accordingly, there is a coupling C intermediate the modules X, X′ and X″, to be interconnected when the said modules are juxtaposed, close but not touching. In practice, the modules including the drive unit Z are attached to the supporting plane by the fasteners 16. Therefore, alignment is first established and then the shafts S1, S2 and S3 are interengaged by the couplings C which comprise an outwardly female member 21 on one module adapted to receive a male member 22 on the next outer module. It is to be understood that this inboard-outboard relationship can be reversed. As shown, the female member 21 is a socket member that opens outwardly on shafts S1, S2 and S3, in order to receive an inwardly projecting stub end portion of the shafts S1 and S2. The drive module X″ has only the outgoing shaft S3 and female drive member 20.

In carrying out this invention, alignment of shafts S1, S2 and S3 is first established whereupon the couplings C are interconnected so as to join said shafts. The installation of modules X, X′ and X″ is then finalized by line drilling through the male member 22 from the surrounding female member 21, and then installing a drift or roll pin 23, said pins being driven into position to rotatably couple the said male and female members. With the modules X, X′ and X″ coupled through shafts S1, S2 and S3 and fastened to the traffic-way, they are static with the supporting surface and in axial alignment prepared for operation.

The drive unit Z motorizes the coordinated tire barrier modules X and traffic barrier Y, and as shown it comprises a prime mover motor M and a gear reducer R, said gear reducer having an output shaft offset from and parallel to the axis of shafts S1, S2 and S3. A feature is that the gear reducer R is non reversible, a worm and wheel drive that holds position when the input worm is stopped. Accordingly, the prime mover motor M turns the worm 28 of said drive and the output is from the wheel 29. In accordance with this invention, the axis of the worm wheel is parallel to and offset from the axis of the drive module shaft S3, the shaft S4 of the drive unit Z being disposed within the housing 30 of the standard of the drive unit Z.

Referring now to the coordinated motorization of the barriers X and Y, the drive unit Z reciprocates between what will be referred to as "stop" and "go" positions. As shown, the wheel 29 revolves reversely in clockwise and counter clockwise directions when moved by the motor M that is reversibly energized. A characteristic feature is that the shaft S4 decelerates to diametrically opposite positions as the motor M comes to rest when it is deactivated and locks the drive unit Z in said reciprocal or center "stop" and "go" positions. The unit Z has a base 34 secured to the supporting plane by hold-down fasteners, to be coplanar with the bases 14 of the modules X, X′ and X″. The motor M and gear reducer R are mounted on the base 34, the motor being placed above the reducer with a pulley-belt drive 33 to the input shaft S5. All shafting is horizontally disposed, and the output shaft S4 parallel to and offset from the shaft S3 of the drive module X″, and on an axis spaced above the axis of the shaft S3. In accordance with this invention, the rotary motion of shaft S3 is reciprocal through an angular displacement closely approximating 90°, while the rotary motion of shaft S4 is tolerant of a substantial variation in terminal position through an angular displacement of approximately 180°. A feature is that an over or under running of the motor M and/or reducer R is through the top and bottom dead center positions of the crank motions and has minimal linear effect upon the positions of link 32 and the resultant positions of shaft S3. The same is true of the lever relationship to link 42 and positions of shaft S6 later described.

Figures 9, 10, 11:
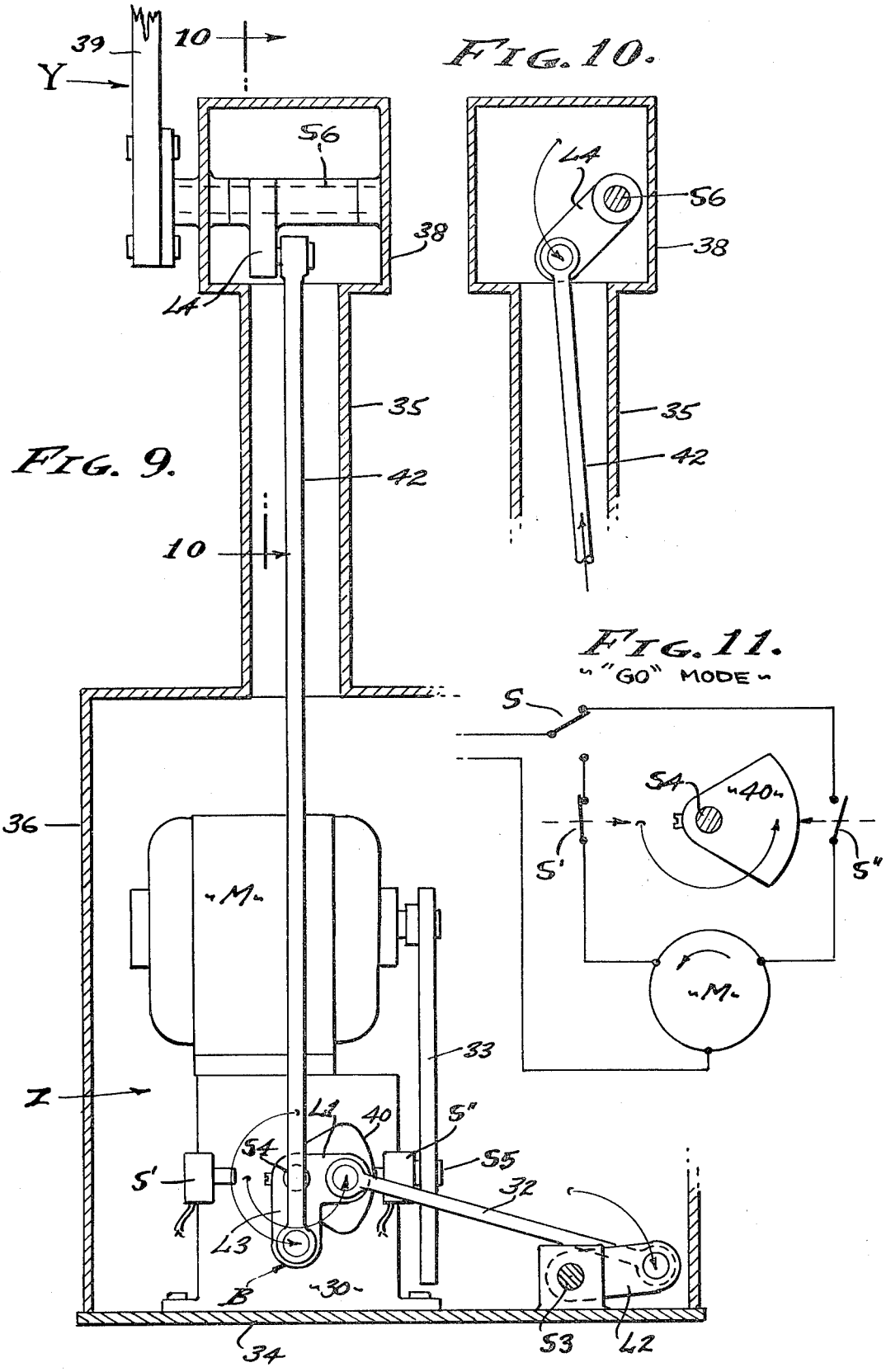

The drive interconnection between shafts S4 and S3 is by means of a crank and lever drive comprised of crank L1 on shaft S4 connected with lever L2 on shaft S3 by means of the link 32. The 90° rotation of lever L2 is determined by the 180° throw of crank L1 as it is aligned approximately through the axis of shaft S4. As shown in FIG. 6, the dead center position of crank L1 pulls lever L2 counterclockwise so as to lift the barrier blades 20, while the reciprocal 180° position of link L1 shown in FIG. 9 pushes lever L2 clockwise so as to depress the barrier blades 20. A feature is the incorporation of crank L1 with a crank L3 in the form of a bellcrank B, said crank L3 operating the signal barrier Y next to be described.

As best illustrated in FIG. 1 of the drawings, the signal barrier Y is comprised of a standard 35 projecting vertically from the housing 36 overlying the base 34 to accommodate the motorized drive unit Z. The standard 35 is tubular and carries a shaft S6 that is revolved reciprocally through an arc closely approximating 90°. The shaft S6 is journaled in a head 38 at the top of standard 35 and disposed horizontally on an axis spaced above and right angularly related to the axis of the output shaft S4 at the reducer R. Accordingly, shaft S6 is disposed on a longitudinal axis parallel to the traffic-way and projecting from head 38 to carry a signal barrier arm 39 between a down "stop" position disposed transversely of the traffic-way and an up "go" position disposed vertically at the side of the traffic-way.

The drive interconnection between shafts S4 and S6 is by means of a crank and lever drive comprised of crank L3 on shaft S4 connected with a lever L4 on shaft S6 by means of a link 42. The 90° rotation of lever L4 is determined by the 180° throw of crank L3 as it is aligned approximately through the axis of shaft S4. As shown, the angular displacement of levers L1 and L3 in the bellcrank B formation thereof is 90°, so that the 0° "stop" position of crank L3 as it is shown in FIG. 6 pushes lever L4 upward so as to lower the barrier arm 39, while the reciprocal 180° "go" position of crank L3 shown in FIG. 9 pulls lever L4 downward so as to lift the barrier arm 39. A feature is the transmission of reciprocal motion in tension between the angularly related axes of shafts S4 and S6, in order to carry the weight of arm 39.

The prime mover is a reversible three wire motor M electrically powered through a single phase electrical service, or the like, and the reciprocal positions of the tire barrier X and coordinated signal barrier Y controlled by the "stop" and "to" switches S′ and S″. The mode switch S is selectively operated to determine motivation into the "stop" or "go" positions, as circumstances require. As shown, the bellcrank B includes a cam 40 of sufficient arc, approximately 90°, to open the normally closed "stop" and "go" switches S′ and S″ through approximately 45° of travel as the barriers X and Y come to rest in said reciprocal positions respectively. The switches S′ and S″ remain open in the "stop" and "go" positions of modes switch S, so as to permit the mechanism to decelerate and come to rest. Exact positioning is noncritical for reasons stated above. The mode switch S is closed to the selected mode and open to the non-selected mode, and for example is a manually operable selector switch in series circuit through separate conductors with "stop" switch S′ and "go" switch S″ to motor M, and which is closed to either switch S′ or S″. This control circuit is direct and reliable and it is not subject to malfunction, as the cam lobe is made adequate to ensure complete deceleration of the mechanism and deenergization of the motor circuit at each terminal position of the motion involved.

From the foregoing it will be seen that a highly practical and improved tire barrier and signal barrier traffic-way controller is provided. The modular structure lends itself to an above grade installation that is easily executed through the coaxial coupling of the juxtaposed modules and the drive unit therefor which coordinates the signal barrier with the tire barrier. The transmission of motion is reduced to the employment of a minimal number of structurally sound members, the movements of which are noncritical while transferring motion between angularly related means. The electrical control switching is applicable to manual as well as automated coin control means, and maintenance is facilitated by the above grade access to all features thereof.

Having described only a typical preferred form and application of my invention, I do not wish to be limited or restricted to the specific details herein set forth, but wish to reserve to myself any modifications or variations that may appear to those skilled in the art as set forth within the limits of the following claims.

I claim:

1. A motorized tire barrier and signal barrier vehicle traffic-way controller, and including:

at least one elongated grade level tire barrier module extending transversely of the vehicle traffic-way, and comprised of a frame with oppositely ramped margins extending to spaced rail members defining a channel for the accommodation of a shaft rotatable therein and coextensive therewith, and a plurality of spaced blades projecting from one side of the shaft to extend upwardly from and retractile into the channel through rotation of the shaft;

a signal barrier at one side of the traffic-way, and comprised of a vertically disposed frame with a standard and a head defining a chamber for the accommodation of a shaft rotatable therein, and an arm projecting from the shaft to extend horizontally across the traffic-way and retractile into a vertical position at the side of the traffic-way through rotation of the shaft;

a drive unit for motorizing the blades and arm between extended "stop" positions and retracted "go" positions, and comprised of a reversible motor drive means with a bellcrank reciprocably operable through an obtuse angular displacement, with a connecting link from a first bellcrank to a lever on the at least one module shaft reciprocably operable through an acute angular displacement, and with a connecting link from a second bellcrank to a lever on the signal arm shaft reciprocably operable through an acute angular displacement;

and control means for reversibly operating the motor drive means and positioning the tire barrier and signal barrier shafts in said "stop" and "go" positions.

2. The motorized tire barrier and signal barrier controller as set forth in claim 1, wherein a plurality of said at least one elongated tire barrier modules is connected together in a transverse alignment by couplers joining the shaft thereof to operate in unison.

3. The motorized tire barrier and signal barrier controller as set forth in claim 1, wherein the shaft of at least one of said elongated tire barrier module is devoid of blades.

4. The motorized tire barrier and signal barrier controller as set forth in claim 1, wherein one of said at least one elongated tire barriers is disposed laterally from the traffic-way and to the drive unit and its shaft devoid of blades.

5. The motorized tire barrier and signal barrier controller as set forth in claim 1, wherein the shaft of at least one of said at least one elongated tire barriers is devoid of blades and is connected between a pair of said at least one elongated tire barriers and in transverse alignment therewith by couplers joining the shafts thereof to operate in unison.

6. The motorized tire barrier and signal barrier controller as set forth in claim 1, wherein one of said at least one elongated tire barriers is disposed laterally from the traffic-way and to the drive unit and its shaft devoid of blades, and wherein the shaft of at least one of said at least one elongated tire barrier is devoid of blades and connected between a pair of said at least one elongated tire barrier and in transverse alignment therewith by couplers joining the shafts thereof to operate in unison.

7. The motorized tire barrier and signal barrier controller as set forth in claim 1, wherein the reversible motor drive means has "stop" and "go" positions of the bellcrank at substantially dead-center diametrically opposite positions in alignment with the link connections to said levers.

8. The motorized tire barrier and signal barrier controller as set forth in claim 1, wherein the reversible motor drive means is a self locking worm and wheel drive having "stop" and "go" positions of the bellcrank at substantially dead-center diametrically opposite positions in alignment with the link connections to said levers.

9. The motorized tire barrier and signal barrier controller as set forth in any one of claims 7 or 8, wherein obtuse angular displacement of the bellcrank is substantially 180°, and wherein the acute angular displacement of the levers is substantially 90°.

10. The motorized tire barrier and signal barrier controller as set forth in claim 1, wherein the control means comprises a mode switch for reversibly operating the motor drive means.

11. The motorized tire barrier and signal barrier controller as set forth in claim 1, wherein the control means comprises "stop" and "go" switches to deenergize the motor drive means for deceleration to said "stop" and "go" positions.

12. The motorized tire barrier and signal barrier controller as set forth in claim 1, wherein the control means comprises a mode switch for reversibly operating the motor drive means, and "stop" and "go" switches to deenergize the motor drive means for deceleration to said "stop" and "go" positions.

13. A drive unit for selective motorized adaptation to a tire barrier and a signal barrier of a traffic-way controller:

wherein the tire barrier comprises at least one elongated grade level tire barrier module extending transversely of the vehicle traffic-way, and comprised of a frame with oppositely ramped margins extending to spaced rail members defining a channel for the accomodation of a shaft rotatable therein and coextensive therewith, and a plurality of spaced blades projecting from one side of the shaft to extend upwardly from and retractile into the channel through rotation of the shaft;

wherein the signal barrier comprises a vertically disposed frame at one side of the traffic-way and with a standard and a head defining a chamber for the accomodation of a shaft rotatable therein, and an arm projecting from the shaft to extend horizontally across the traffic-way and retractile into a vertical position at one side of the traffic-way through rotation of the shaft;

the said drive unit being selectively coupled with and to operate the signal barrier arm and the tire barrier blades between extended "stop" positions and retracted "go" positions, and comprised of a reversible motor drive means with a bellcrank reciprocably operable through an obtuse angular displacement, with a connecting link to be coupled from a first bellcrank to a lever on the at least one module shaft reciprocably operable through an acute angular displacement, and with a connecting link to be coupled from a second bellcrank to a lever on the signal arm shaft reciprocably operable through an acute angular displacement;

and control means for reversibly operating the motor drive means and conditioning the traffic-way controller in said "stop" and "go" positions.

14. The drive unit for a traffic-way controller as set forth in claim 13, wherein the reversible motor drive means has "stop" and "go" positions of the bellcrank at substantially dead-center diametrically opposite positions in alignment with the link connecting to said tire barrier lever.

15. The drive unit for a traffic-way controller as set forth in claim 13, wherein the reversible motor drive means is a self locking worm and wheel drive having "stop" and "go" positions of the bellcrank at substantially dead-center diametrically opposite positions in alignment with the link connecting to said tire barrier lever.

16. The drive unit for a traffic-way controller as set forth in any one of claims 14 and 15, wherein obtuse angular displacement of the bellcrank is substantially 180°, and wherein the acute angular displacement of the levers is substantially 90°.

17. The drive unit for a traffic-way controller as set forth in claim 13, wherein the control means comprises a mode switch for reversibly operating the motor drive means.

18. The drive unit for a traffic-way controller as set forth in claim 13, wherein the control means comprises "stop" and "go" switches to deenergize the motor drive means for decelerating to said "stop" and "go" positions.

19. The drive unit for a traffic-way controller as set forth in claim 13, wherein the control means comprises a mode switch for reversibly operating the motor drive means, and "stop" and "go" switches to deenergize the motor drive means for decelerating to said "stop" and "go" positions.

* * * * *